US011428474B2

(12) United States Patent
Riebel et al.

(10) Patent No.: US 11,428,474 B2
(45) Date of Patent: Aug. 30, 2022

(54) PLATE HEAT EXCHANGER

(71) Applicant: Modine Manufacturing Company, Racine, WI (US)

(72) Inventors: Alexander Riebel, Stuttgart (DE); Wolfgang Schatz-Knecht, Reutlingen (DE)

(73) Assignee: Modine Manufacturing Company, Racine, WI (US)

( * ) Notice: Subject to any disclaimer, the term of this patent is extended or adjusted under 35 U.S.C. 154(b) by 100 days.

(21) Appl. No.: 16/879,003

(22) Filed: May 20, 2020

(65) Prior Publication Data

US 2020/0370835 A1 Nov. 26, 2020

Related U.S. Application Data

(60) Provisional application No. 62/852,348, filed on May 24, 2019.

(51) Int. Cl.

| | |
|---|---|
| ***F28D 9/00*** | (2006.01) |
| ***F28F 3/12*** | (2006.01) |
| *F28F 13/12* | (2006.01) |

(52) U.S. Cl.

CPC ..... *F28D 9/0037* (2013.01); *F28D 9/0075* (2013.01); *F28F 3/12* (2013.01);
(Continued)

(58) Field of Classification Search

CPC .... F28D 9/0037; F28D 9/0075; F28D 1/0325; F28D 1/03; F28D 1/0375; F28F 3/12;
(Continued)

(56) References Cited

U.S. PATENT DOCUMENTS 7,004,237 B2 * 2/2006 Mathur ..... F28D 9/0006 165/167
9,250,019 B2 * 2/2016 Han ..... F28D 9/0043
(Continued)

FOREIGN PATENT DOCUMENTS

CN 101646915 A 2/2010
CN 103808189 A 5/2014
(Continued)

OTHER PUBLICATIONS

Extended Search Report issued from the European Patent Office for related Application No. 20175929.7 dated Sep. 11, 2020 (7 Pages).
(Continued)

*Primary Examiner* — Tho V Duong
(74) *Attorney, Agent, or Firm* — Michael Best & Friedrich LLP

(57) ABSTRACT

A plate heat exchanger includes a stack of plate pairs with gaps between adjacent pairs, arranged to provide flow paths for a first fluid to pass through inner volumes of the plate pairs while simultaneously allowing a second fluid to flow over the outer surfaces of the plate pairs. At least one cylindrical fluid manifold for the first fluid extends through the plate pairs. A non-planar cap is arranged at one end of the plate heat exchanger to close off the cylindrical fluid manifold. A reinforcement plate is arranged at that end between the non-planar cap and an end plate of the plate heat exchanger. The position of the non-planar cap relative to a central axis of the cylindrical fluid manifold is maintained in order to prevent failure of the plate heat exchanger due to internal pressurization.

12 Claims, 2 Drawing Sheets

(52) U.S. Cl.
CPC ..... *F28F 13/12* (2013.01); *F28F 2220/00* (2013.01); *F28F 2225/02* (2013.01); *F28F 2240/00* (2013.01)

(58) Field of Classification Search
CPC .... F28F 13/12; F28F 2220/00; F28F 2225/02; F28F 2240/00
USPC ..... 165/166
See application file for complete search history.

(56) References Cited

U.S. PATENT DOCUMENTS

| | | | | |
|---|---|---|---|---|
| 2007/0000639 | A1* | 1/2007 | Ozawa | F28F 9/0246 165/41 |
| 2008/0216987 | A1* | 9/2008 | Thumm | F28F 3/027 165/67 |
| 2009/0266507 | A1 | 10/2009 | Turnbull et al. | |
| 2015/0285572 | A1 | 10/2015 | Fleitling et al. | |
| 2020/0318914 | A1* | 10/2020 | Hata | F28D 9/00 |

FOREIGN PATENT DOCUMENTS

| | | | |
|---|---|---|---|
| CN | 104215113 | A | 12/2014 |
| JP | 2005 337528 | A | 12/2005 |
| KR | 20090063068 | A | 6/2009 |
| WO | 2004/027334 | A1 | 4/2004 |
| WO | 2011/159227 | A1 | 12/2011 |
| WO | 2015150321 | A2 | 10/2015 |

OTHER PUBLICATIONS

First Office Action from the Chinese Patent Office for related Application No. 202010447496.2 dated Jul. 27, 2021 (16 Pages).

* cited by examiner

PLATE HEAT EXCHANGER

CROSS-REFERENCE TO RELATED PATENT APPLICATIONS

This application claims priority to U.S. Provisional Patent Application No. 62/852,348 filed on May 24, 2019, the entire contents of which are hereby incorporated by reference.

BACKGROUND

Heat exchangers for efficiently transferring heat between fluid streams while maintaining physical separation between those fluid streams are known. Such heat exchangers are typically constructed from metal materials having a high thermal conductivity, such as alloys of aluminum or copper. In some cases one or more of the fluids are corrosive and/or at elevated pressure, requiring the use of materials such as titanium and stainless steel. All of these types of heat exchangers can be produced by brazing.

Plate heat exchangers are one particular type of such heat exchangers, and are constructed as a stack of plate pairs with one fluid flowing through the plate pairs. Such heat exchangers are on occasion used in high-pressure applications, wherein the fluid passing through the plate pairs is at an elevated pressure. In such an application, care must be taken in designing and building the heat exchanger in order to prevent early structural failure of the heat exchanger due to the internal pressurization. Such heat exchangers are especially prone to structural failure caused by internal pressure at the locations of fluid manifolds for the fluid passing through the plate pairs.

SUMMARY

A plate heat exchanger includes a stack of plate pairs with gaps between adjacent pairs, arranged to provide flow paths for a first fluid to pass through inner volumes of the plate pairs while simultaneously allowing a second fluid to flow over the outer surfaces of the plate pairs. At least one cylindrical fluid manifold for the first fluid extends through the plate pairs. A non-planar cap is arranged at one end of the plate heat exchanger to close off the cylindrical fluid manifold. A reinforcement plate is arranged at that end between the non-planar cap and an end plate of the plate heat exchanger.

The reinforcement plate is joined to both the end plate and the non-planar cap. The joining can be by brazing, or by welding, or by other known means of joining parts. When the joining is accomplished by brazing, then the brazed joint can be made concurrently with brazing together the plate pairs to form the stack.

The location of the reinforcing plate within a plane perpendicular to a central axis of the cylindrical fluid manifold can be fixed by features of the end plate. In some cases, those features of the end plate can include an upturned flange provided around the periphery or a circular aperture within the end plate, with the cylindrical fluid manifold extending through that circular aperture. In other cases, the end plate can be provided with other features to fix the location of the reinforcing plate.

The reinforcing plate can have a circular opening extending through the thickness of the reinforcing plate. The location of the reinforcing plate within a plane perpendicular to the central axis of the cylindrical fluid manifold can be fixed by the features so that the circular opening of the reinforcement plate is axially aligned with the cylindrical fluid manifold. The outer boundary of the reinforcement plate can be circular, so that the reinforcement plate is annular in shape. The outer boundary of the reinforcement plate can alternatively be of a different, including but not limited to square, rectangular, hexagonal, or octagonal.

The location of the non-planar cap within the plane perpendicular to the central axis of the cylindrical fluid manifold can be fixed by features of the reinforcement plate. Those features of the reinforcement plate can include protrusions that extend away from the end plate. Each one of those protrusions can be located further from the central axis than an outer periphery of the non-planar cap. The reinforcement plate can be provided with three such protrusions, or it can be provided with more than three such protrusions, such as four, five, six, or more protrusions.

Each one of the protrusions on the reinforcement plate can be spaced away from the central axis of the cylindrical fluid manifold by the same radial distance. Each one of the protrusions on a single reinforcement plate can be spaced equidistantly from each other one of the protrusions on that reinforcement plate.

The protrusions on the reinforcement plate can be formed as semi-piercings. Alternatively, the protrusions can be formed in other ways, including but not limited to stamping, forming, drawing, lancing, dimpling, and other metal forming operations.

The non-planar cap can include a centrally located domed portion, and a planar portion surrounding the centrally domed portion. The non-planar cap can be joined to the reinforcement plate by the planar portion. The planar portion can be annularly shaped, or can have other shapes. The centrally located domed portion can include a first arcuately-shaped portion extending into the fluid manifold and a second arcuately-shaped portion surrounding the first arcuately-shaped portion and extending away from the end plate.

DETAILED DESCRIPTION

Before any embodiments of the invention are explained in detail, it is to be understood that the invention is not limited in its application to the details of construction and the arrangement of components set forth in the following description or illustrated in the accompanying drawings. The invention is capable of other embodiments and of being practiced or of being carried out in various ways. Also, it is to be understood that the phraseology and terminology used herein is for the purpose of description and should not be regarded as limiting. The use of "including," "comprising," or "having" and variations thereof herein is meant to encompass the items listed thereafter and equivalents thereof as well as additional items. Unless specified or limited otherwise, the terms "mounted," "connected," "supported," and "coupled" and variations thereof are used broadly and encompass both direct and indirect mountings, connections, supports, and couplings. Further, "connected" and "coupled" are not restricted to physical or mechanical connections or couplings.

Figure 1:
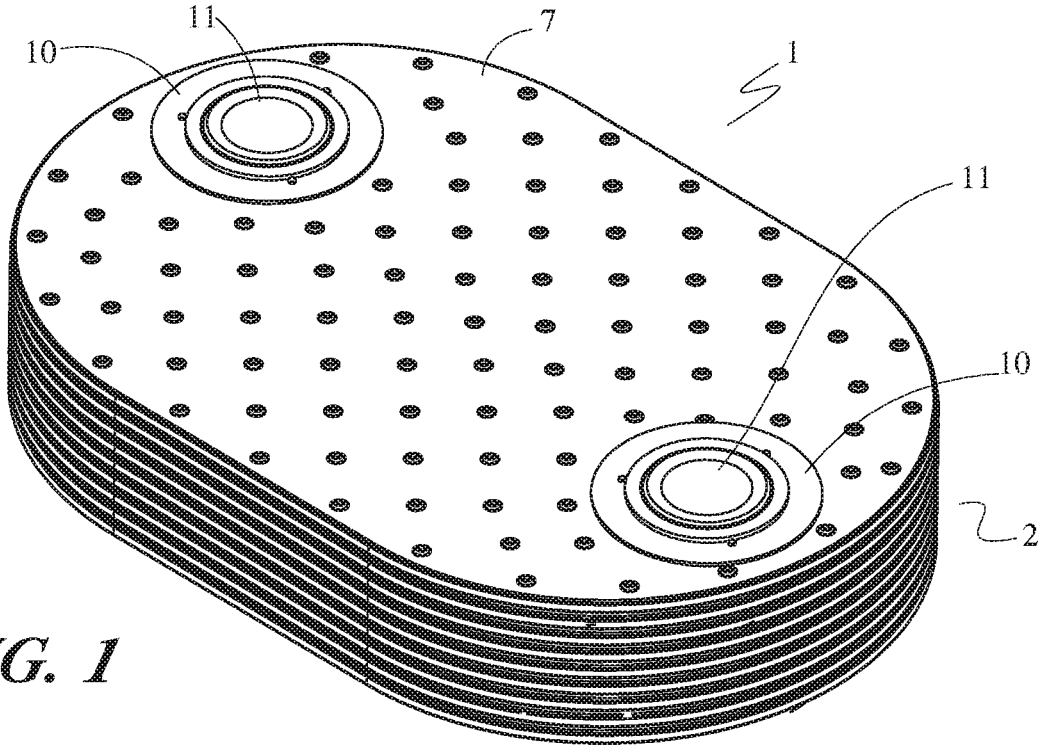
FIG. 1 is a perspective view of a plate heat exchanger according to some embodiments of the invention.
Figure 2:
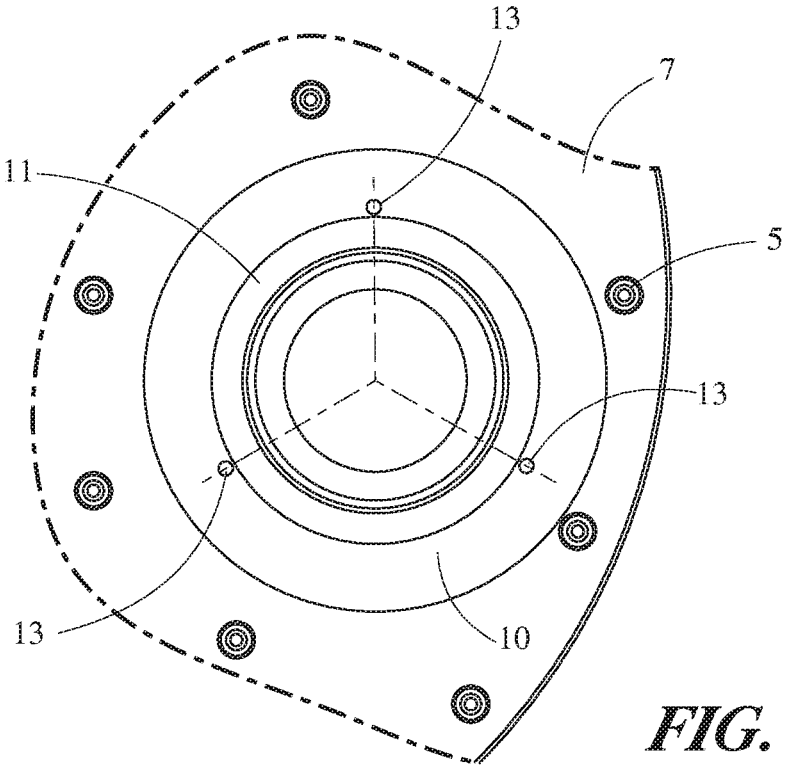
FIG. 2 is a detail view of certain features of the plate heat exchanger of FIG. 1.
Figure 3:
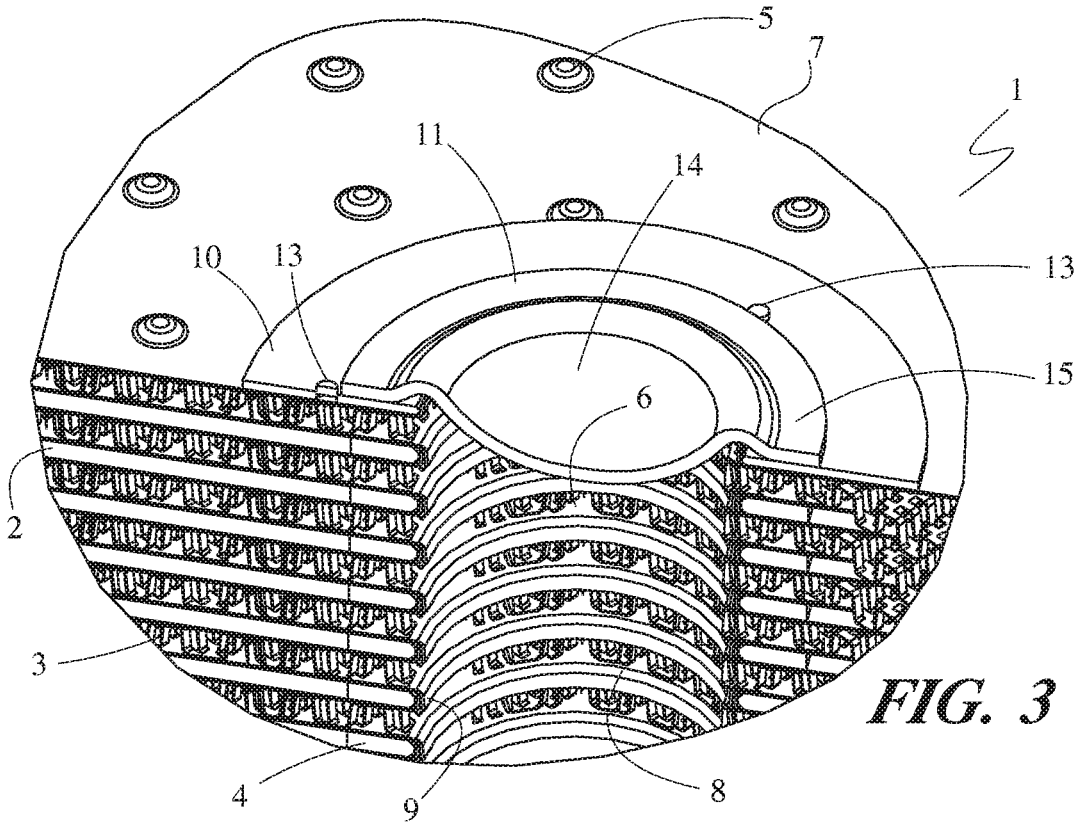
FIG. 3 is a partially sectioned perspective view of a portion of the plate heat exchanger of FIG. 1.
Figure 4:
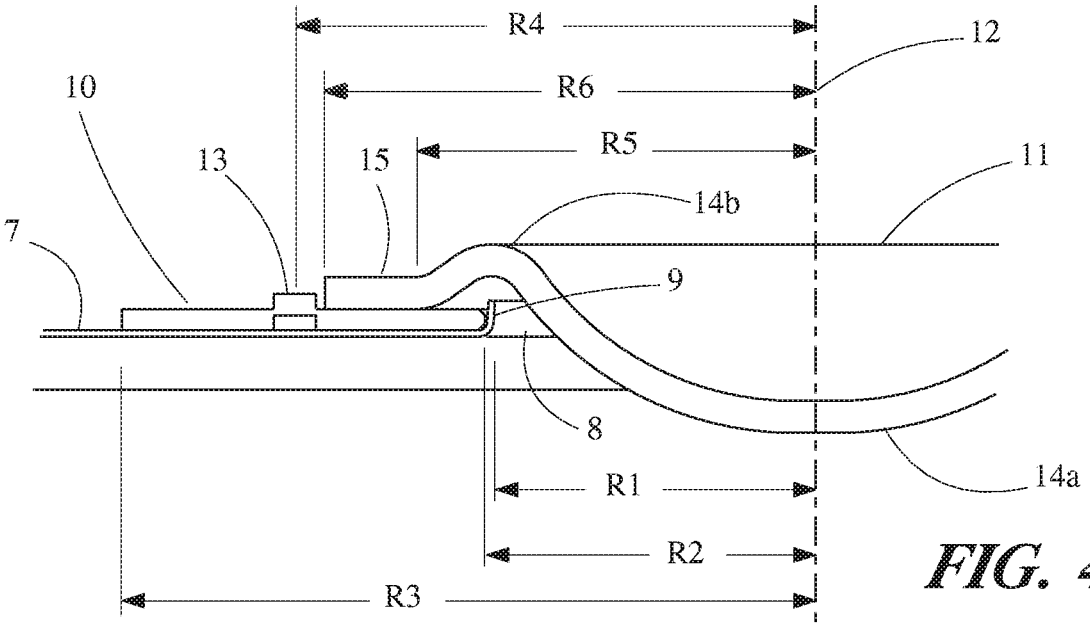
FIG. 4 is a section view showing certain features of the plate heat exchanger of FIG. 1.

A plate heat exchanger 1 is depicted in FIG. 1, and various particularly relevant features of the plate heat exchanger 1 are depicted in greater detail in FIGS. 2-4. The plate heat exchanger is especially useful in transferring heat between two liquid flows, particularly when one of the two liquid flow is at an elevated pressure. One specific application where such a heat exchanger may find utility is in the cooling of transmission or engine oil in a combustion engine, and certain advantages of the plate heat exchanger in such an application will be described for exemplary purposes. It should be understood, however, that the plate heat exchanger 1, or other heat exchangers having such features, is not limited to use in that particular application.

The plate heat exchanger 1 is constructed as a stack of plate pairs 2, each of the plate pairs 2 being spaced apart from the adjacent plate pairs 2 to define gaps therebetween. A first fluid (for example, high-pressure oil) is directed to flow through internal spaces of the plate pairs 2 while a second fluid (for example, engine coolant) is directed to flow through the gaps between the plate pairs 2 so as to flow over the outer surfaces of the plates.

As the two fluids flow through the plate heat exchanger 1, thermal energy can be transferred between them. In some cases, the first fluid is at a higher temperature than the second fluid and the plate heat exchanger 1 is used to transfer heat from the first fluid to the second fluid in order to cool the first fluid to a desirable temperature. In other cases the first fluid is at a lower temperature than the second fluid and the plate heat exchanger 1 is used to transfer heat from the second fluid to the first fluid in order to heat the first fluid to a desirable temperature. The plate heat exchanger 1 can also be used to cool or heat the second fluid to a desirable temperature by transferring heat to or from the first fluid.

The plate heat exchanger 1 is preferably constructed as a brazed assembly of metal components. A variety of metals can be used to construct the plate heat exchanger 1, including but not limited to aluminum, steel, stainless steel, and copper. At least some of the components used in the construction can have a clad layer of braze alloy applied to them, or the braze alloy can be applied as a separate component (for example, as a foil or a paste), or both.

The plate pairs 2 can be joined together to form a stack, while simultaneously providing the gaps for the second fluid to flow through by the presence of outwardly facing dimples 5 that are formed into the plates. The patterns of dimples can be such that the dimples 5 of an upwardly facing plate abut and are joined to the dimples 5 of an adjacent downwardly facing plate. The plate heat exchanger 1 can be inserted into a cavity through which the second fluid flows, so that the second fluid can be directed through the gaps and over the plate surfaces. The pattern of the dimples 5 can be adjusted to provide for both the requisite structural integrity of the stack of plate pairs 2, as well as to provide beneficial flow turbulation of the second fluid in order to enhance the rate of heat transfer between the fluids.

Turbulators 3 are located within the flow spaces in each of the plate pairs 2. The turbulators 3 are porous to fluid flow, in order to allow the first fluid to flow through the turbulators 3, while still providing structural support to the plate pair 2. Each turbulator 3 is preferably formed from a thin sheet of metal material to provide crests that are joined to inwardly facing surfaces of one of the plates in the plate pair 2, and troughs that are joined to inwardly facing surfaces of the other one of the plates in the plate pair 2. One particularly useful style of turbulator 3 is a lanced-and-offset turbulator, such as the ones depicted in FIG. 3. This style of turbulator allows for the fluid to flow in multiple directions through the turbulator, and provides for highly efficient heat transfer due to its turbulation effects.

In addition to enhancing the heat transfer, the turbulators 3 are particularly useful in structurally supporting each plate pair 2 against internal pressurization. In some particular applications, including some oil cooling applications, the operating pressure of the first fluid passing through the internal volumes of the plate pairs 2 (e.g. a flow of hydraulic or transmission or engine oil) can be 10 bar or higher in pressure during operation of the plate heat exchanger. In contrast, the pressure of the fluid flowing over the outer surfaces of the plate pairs 2 is typically much lower, leading to a pressure differential. This pressure differential results in a net pressure force that acts upon the inwardly facing surfaces of the plate pairs. In such an application, the turbulators 3 provide structural connections between the plates of the pairs 2 that are sufficient to prevent pressure cycle failure of the plate pairs 2 that would otherwise result from those pressure forces.

Fluid manifolds 6 for the first fluid extend through the stack of plate pairs 2 to allow for the entry and exit of the first fluid into and out of the plate pairs 2 of the plate heat exchanger 1. The fluid manifold 6 shown in FIG. 3 is cylindrical in shape, and extends along the stack height of the plate pairs 2. The fluid manifold 6 is at least partially defined by circular apertures 8 of each plate in the plate pairs 2. A flange 9 extends around the periphery of the aperture 8 in an outwardly direction, so that flanges 9 of adjacent plate pairs 2 engage and join together in the spaces between the plate pairs 2 in order to seal the manifold 6 from the second fluid flowing between the plate pairs. The cylindrical fluid manifolds 6 are in direct fluid communication with the internal flow volumes of the plate pairs 2, so that the first fluid can be directed into those flow volumes (and the turbulators 3 located therein) from one of the fluid manifolds 6 that acts as the inlet manifold, and out of the flow volumes to one of the fluid manifolds 6 that acts as the outlet manifold. Corresponding apertures are cut out of the turbulators 3 in the region of the fluid manifold 6 so that the manifold is unobstructed to the fluid flow.

The fluid manifold 6 is open at one end of the plate heat exchanger 1 to connect the fluid manifold 6 with a flow circuit for the first fluid, and is closed at one end of the plate heat exchanger 1, the closed end being opposite the open end. A non-planar cap 11 is used to close off the closed end. As best seen in FIGS. 3 and 4, the non-planar cap 11 has a domed shape 14 over a central portion of the non-planar cap 11. This domed shape allows the cap 8 to be formed from relatively thin metal sheet material while maintaining the ability to resist the pressure forces imposed by the first fluid when the plate heat exchanger 1 is used in a high-pressure application.

The cylindrical fluid manifold has a radius (indicated as R1 in FIG. 4) that must be sized large enough to ensure that the first fluid is evenly distributed among the various plate pairs 2. If the cylindrical fluid manifold 6 has a radius R1 that is too small, then the additional pressure drop experienced by the first fluid as it passes from the open end to the plate pairs nearest to the closed end (or vice-versa) will cause a maldistribution of the first fluid such that the plate pairs 2 nearest to the open end will receive a greater portion of the first fluid than those plate pairs 2 nearest to the closed end. Such a maldistribution can result in an undesirable reduction in the heat exchange effectiveness of the plate heat exchanger 1. It is therefore preferable for the fluid manifold 6 to have a sufficiently large radius R1.

When the plate heat exchanger 1 is used in a high-pressure application, substantial forces can be imposed on the cap 11. The pressure forces acting on that cap 11 are equal to the gage pressure of the fluid within the fluid manifold 6 (i.e. the pressure difference between that fluid and the external pressure) multiplied by the cross-sectional area of the fluid manifold 6. This cross-sectional area and, consequently, the pressure force has a second-order (i.e. squared) relationship to the radius R2 of the cylindrical fluid manifold 6. As a result, the fluid manifold 6 can become a structural weak spot of the plate heat exchanger 1.

The domed shape of the non-planar cap 11 is much more resistant to deformation due to the pressure forces than a planar cap would be. As the pressure forces act upon the domed shape 14, the resultant stresses resolve to hoop stresses acting along the curved direction of the shape profile, rather than as forces oriented normal to the thickness of the material. Consequently, the non-planar cap 11 can be made of substantially thinner material than if it were planar and still resist deformation due to the pressure loading.

The non-planar cap 11 is joined to the plate heat exchanger 1 along its outer periphery. The pressure forces imposed upon the non-planar cap 11 by the pressure of the first fluid in the manifold 6 act at that joint as a tensile force acting in the direction of the central axis 12 of the cylindrical fluid manifold 6. This tensile force is resisted by those portion of the turbulators 3 that are in the region of the fluid manifold 6, as well as by annular spacers 4 that surround the joined flanges 9 in the gaps between the plate pairs 2, the annular spacers 4 joining together those adjacent plate pairs 2.

In order to reinforce the thin material of the outermost one of the plate pairs 2 in the region of the cylindrical fluid manifold 6, a reinforcement plate 10 is joined to an end plate 7 of the plate heat exchanger 1, the end plate 7 being the outwardly facing plate of the outermost plate pair 2 located at the closed end. Since the turbulator 3 within that outermost plate pair 2 will reinforce the plate pair against internal pressure loading from the first fluid in the regions away from the fluid manifold 6, the thicker reinforcement plate is only needed in a region immediately surrounding that cylindrical fluid manifold 6. Consequently, the reinforcement plate 10 can be provided with an annular shape having an inner radius R2 that is slightly larger than the radius R1 of the fluid manifold 6, and a somewhat larger outer radius R3. The inner radius R2 need only be sufficiently large to surround the flange 9 that extends around the periphery of the aperture 8 of that end plate 7.

The non-planar cap 11 is joined to the reinforcement plate 10, and the tensile force resulting from the pressure loading on the non-planar cap 11 is transferred to the plate heat exchanger 1 through that joint. In order to provide sufficient bearing surface over which to distribute the tensile forces, the non-planar cap 11 is provided with a planar portion 15 that surrounds the domed central portion 14. The planar portion 15 is annular in shape, with an inner radius R5 that is larger than the radius R2, and with an outer radius R6 that is smaller than the radius R3.

The domed portion 14 includes a first arcuately shaped portion 14*a* that extends into the fluid manifold 6, and a second arcuately shaped portion 14*b* that is connected to the planar portion 15 and that surrounds the first arcuately shaped portion 14*a*. The second arcuately shaped portion 14*b* is domed in the direction opposite to the first arcuately shaped portion 14*a*, i.e. extending away from the end plate 7. This profile of the domed portion 14 allows for a design with a lower height than if it had a single outwardly extending dome without sacrificing any structural rigidity.

As can be seen in the cross-section of FIG. 4, the domed shape 14 allows the non-planar cap 11 a substantial degree of freedom to move within a plane perpendicular to the central axis 12. This has the potential to result in the cap 11 being joined to the reinforcement plate 10 with a substantial misalignment of the cap 11 to the central axis 12. Particularly, the outwardly curved domed portion 14*b* creates a clearance area in the region around the radial distances R1 and R2 from the central axis 12 of the fluid manifold 6. In addition, a clearance range is provided between the inwardly curved domed portion 14*a* and the upturned flange 9 of the end plate 7. Displacement of the non-planar cap 11 along a plane perpendicular to the central axis 12 is thereby accommodated until either domed portion 14*a* contacts the upturned flange 9 of the end plate 7, or the inner edge of the planar portion 15 contacts any portion of the upturned flange 9 that extends beyond the top surface of the reinforcement plate 10.

The inventors have found that a misalignment between an axis of revolution of the non-planar cap 11 and the central axis 12 of the cylindrical manifold 6 can substantially reduce the ability of the plate heat exchanger 1 to withstand repeated pressure cycling without failure. While not wishing to be bound by theory, it is believed that the misalignment of the non-planar cap 11 results in the tensile load applied through the joint between the annularly-shaped planar portion 15 and the reinforcement plate 10 to be shifted, along apportion of the periphery of the cylindrical manifold 6, to those convolutions of the turbulator 3 in terminal plate pair 2 that are near or at the radial distance R1, i.e. near the aperture that was cut into the turbulator 3 to accommodate the fluid manifold 6, rather than those convolutions located a radial distance between R5 and R6 from the central axis 12. This is believed to cause cracks to appear in those convolutions, resulting in an inability of the turbulator 3 to adequately perform its structural support function of the plate pair 2 in that region and causing structural failure of the plate heat exchanger 1.

In order to prevent the aforementioned structural failure, the location of the non-planar cap 11 along the plane perpendicular to the central axis 6 must be controlled and maintained prior to and during the brazing process. It is especially desirable that this be done without requiring any additional locating features to be provided by the end plate 7 itself, since the end plate 7 is preferably identical to the corresponding late in all of the other plate pairs 2. In the exemplary embodiment of FIGS. 1-4, this is achieved by a series of protrusions 13 that are formed into the reinforcement plate 10 at specific locations. The protrusions 13 extend outwardly from the reinforcement plate 10, and are located at a radial distance R4 from the central axis 12, that radial distance R4 being slightly greater than the radial distance R6. As the non-planar cap shifts along the plane perpendicular to the central axis 12, the outer edge of the planar portion 15 will abut at least one of the protrusions 13 so that the displacement is adequately restricted.

The radial distance R4 of each protrusion 13 from the central axis 12 of the cylindrical manifold 6 is fixed and maintained by the inner radius R2 of the reinforcement plate 10 being only minimally larger than the radius R1 of the cylindrical manifold 6. This results in a forced concentricity of the reinforcement plate 10 and the cylindrical manifold 6, since the upturned flange 9 of the end plate 7 will engage the inner cylindrical surface of the annular reinforcement plate 10 to prevent any misalignment of the reinforcement plate 10. It can be particularly advantageous for a fillet or chamfer to be provided at the circular edge at the intersection of that inner cylindrical surface of the reinforcement plate 10 and the planar surface of the reinforcement plate 10 that contacts the end plate 7, in order to accommodate and bend radius of the upturned flange 9.

In the exemplary embodiment, a total of three protrusions 13 are provided in each reinforcement plate 10, this being the minimum number of such protrusions 13 necessary to prevent the displacement of the non-planar cap along the plane in any direction. It should be understood, however, that more than three protrusions may be present in other embodiments.

Within each reinforcement plate 10, each one of the protrusions 13 is spaced equidistantly from each other one of the protrusions 13. As best seen in FIG. 2, this is achieved by having each protrusion arranged at an angle of 120° from the other protrusions 13.

One particularly preferable way to form the protrusions 13 is as semi-piercings. Semi-piercing is a sheet metal forming process wherein a punch and die are used to displace a portion of the sheet material without completely shearing the material, creating a protrusion that extends from a surface of the material by an amount less than the material thickness. As shown in the cross-sectional view of FIG. 4, the resulting protrusion 13 is formed with no or nearly no fillet radius, thus preventing the non-planar cap 11 from riding up and over the protrusion 13 as it displaces into the protrusion.

Various alternatives to the certain features and elements of the present invention are described with reference to specific embodiments of the present invention. With the exception of features, elements, and manners of operation that are mutually exclusive of or are inconsistent with each embodiment described above, it should be noted that the alternative features, elements, and manners of operation described with reference to one particular embodiment are applicable to the other embodiments.

The embodiments described above and illustrated in the figures are presented by way of example only and are not intended as a limitation upon the concepts and principles of the present invention. As such, it will be appreciated by one having ordinary skill in the art that various changes in the elements and their configuration and arrangement are possible without departing from the spirit and scope of the present invention.

What is claimed is:

1. A plate heat exchanger comprising:

a cylindrical fluid manifold extending through the plate heat exchanger;

an end plate of the heat exchanger arranged at one end of the heat exchanger, the end plate having a circular aperture to allow the fluid manifold to extend through the end plate;

a non-planar cap arranged at the one end of the heat exchanger to close off the cylindrical fluid manifold; and a reinforcement plate arranged between and joined to the end plate and the non-planar cap, the location of the reinforcing plate within a plane perpendicular to a central axis of the cylindrical fluid manifold being fixed by features of the end plate, and the location of the non-planar cap within that plane being fixed by features of the reinforcement plate, wherein the reinforcement plate is annular in shape, such that the reinforcement plate has an inner boundary defining a circular opening.

2. The plate heat exchanger of claim 1, wherein said features of the end plate include an upturned flange around the periphery of the circular aperture.

3. The plate heat exchanger of claim 1, wherein said features of the reinforcement plate include a plurality of protrusions extending away from the end plate, the plurality of protrusions being located further from the central axis than an outer periphery of the non-planar cap.

4. The plate heat exchanger of claim 3, wherein each one of the plurality of protrusions is spaced away from the central axis by the same radial distance.

5. The plate heat exchanger of claim 3, wherein the plurality of protrusions consists of three protrusions.

6. The plate heat exchanger of claim 5, wherein each one of the plurality of protrusions is spaced equidistantly from each other one of the plurality of protrusions.

7. The plate heat exchanger of claim 3, wherein the plurality of protrusions are semi-piercings.

8. The plate heat exchanger of claim 1, wherein the non-planar cap includes a centrally located domed portion and a planar portion surrounding the centrally located domed portion, the non-planar cap being joined to the reinforcement plate by the planar portion.

9. The plate heat exchanger of claim 8, wherein the centrally located domed portion includes a first arcuately-shaped portion extending into the fluid manifold and a second arcuately-shaped portion surrounding the first arcuately-shaped portion and extending away from the end plate.

10. The plate heat exchanger of claim 1, wherein the end plate is an outermost plate of the plate heat exchanger.

11. The plate heat exchanger of claim 1, wherein the inner boundary of the reinforcement plate defines an inner radius and an outer boundary of the reinforcement plate defines an outer radius that is larger than the inner radius, and wherein the outer boundary is circular.

12. The plate heat exchanger of claim 8, wherein the planar portion of the non-planar cap has an outer circumference and an inner circumference, and wherein the inner boundary of the reinforcement plate has a circumference that is less than the outer circumference of the planar portion of the non-planar cap and that is less than the inner circumference of the planar portion of the non-planar cap.

* * * * *